United States Patent [19]

Fischer

[11] Patent Number: 4,840,110

[45] Date of Patent: Jun. 20, 1989

[54] DEVICE FOR STORING AND LOADING AMMUNITION IN A TURRET

[75] Inventor: Helmut Fischer, Dusseldorf, Fed. Rep. of Germany

[73] Assignee: Rheinmetall GmbH, Düsseldorf, Fed. Rep. of Germany

[21] Appl. No.: 149,329

[22] Filed: Jan. 28, 1988

[30] Foreign Application Priority Data

Jan. 28, 1987 [DE] Fed. Rep. of Germany ..... 3702426

[51] Int. Cl.[4] ..... F41F 9/06

[52] U.S. Cl. ..... 89/46; 89/33.02; 89/33.04

[58] Field of Search ..... 89/45, 46, 33.02, 33.04, 89/33.1, 33.17

[56] References Cited

U.S. PATENT DOCUMENTS

| | | | |
|---|---|---|---|
| 2,910,917 | 11/1959 | Herlach et al. . | |
| 2,951,422 | 9/1960 | Bobkowski | 89/33.14 |
| 3,376,785 | 4/1968 | Elwin . | |
| 4,064,786 | 12/1977 | Elwin . | |
| 4,127,055 | 11/1978 | Hottinger et al. . | |
| 4,395,936 | 8/1983 | Lundin | 89/46 |
| 4,494,441 | 1/1985 | Magnuson | 89/46 |
| 4,524,673 | 6/1985 | Golden | 89/33.02 |

FOREIGN PATENT DOCUMENTS

| | | | |
|---|---|---|---|
| 148423 | 7/1985 | European Pat. Off. | 89/46 |
| 1264296 | 10/1968 | Fed. Rep. of Germany . | |
| 2501425 | 7/1975 | Fed. Rep. of Germany | 89/45 |
| 1703379 | 1/1976 | Fed. Rep. of Germany . | |
| 716181 | 10/1966 | Italy | 89/33.17 |
| 104907 | 6/1942 | Sweden | 89/46 |
| 735278 | 8/1955 | United Kingdom | 89/45 |
| 1523432 | 8/1978 | United Kingdom | 89/46 |
| 2025008 | 1/1980 | United Kingdom | 89/46 |

*Primary Examiner*—Deborah L. Kyle
*Assistant Examiner*—Stephen Johnson
*Attorney, Agent, or Firm*—Spencer & Frank

[57] ABSTRACT

A device for storing and loading unbelted ammunition in a turret equipped with a tubular weapon, the tubular weapon being equipped with one shaft magazine on either side, with a ring magazine to receive ammunition disposed in the turret basket. Each respective shaft magazine can be supplied with ammunition by way of an associated lifting device. A ring magazine is disposed in a turret basket so as to be rotatable about its axis by means of a drive. Vertical, radially oriented shafts are provided in the ring magazine to receive ammunition and an auxiliary shaft device fixed to the turret is disposed above the ring magazine, with the shaft magazines being articulated to the tubular weapon in such a manner that their shafts, with the tubular weapon in an indexed position, are aligned with the auxiliary shafts of the auxiliary shaft device which are an upward extension of the shafts of ring magazine therebelow, whereby any two types of freely selectable ammunition may be loaded into the respective shaft magazines via the ring magazine and auxiliary shaft device.

5 Claims, 1 Drawing Sheet

DEVICE FOR STORING AND LOADING AMMUNITION IN A TURRET

BACKGROUND OF THE INVENTION

The present invention relates to a device for storing and loading unbelted ammunition in a turret provided with a tubular weapon which is equipped with one shaft magazine on either side which can be supplied with ammunition by way of an associated lifting device, and with a ring magazine to receive ammunition, disposed in the turret basket.

German Pat. No. 1,264,296 discloses the provision of a shaft magazine on each side of a twin gun to which ammunition is provided from a ring magazine disposed therebelow by way of an ammunition lift. The ring magazine here has horizontal chambers. If different types of ammunition are to be fired, a fixed ammunition code must be utilized between the types of ammunition to be employed. Thus, it is not possible to load at will.

SUMMARY OF THE INVENTION

It is therefore an object of the invention to provide a device as defined for storing and loading unbelted ammunition in a turret equipped with a tubular weapon equipped with one shaft magazine on either side which can be supplied with ammunication by way of an associated lifting device, and with a ring magazine to receive ammunition, disposed in the turret basket in which practically any freely selectable pieces of ammunition of two types can be loaded.

This is accomplished by providing that the ring magazine is disposed in the turret basket so as to be rotatable about its axis by means of a drive, vertical, radially oriented shafts are provided to receive ammunition and an auxiliary shaft device fixed to the turret is disposed above the ring magazine, with the shaft magzines being articulated to the tubular weapon in such a manner that their shafts, with the tubular weapon in the indexed position, are aligned with the auxiliary shafts of the auxiliary shaft device which are an upward extension of the shafts of the ring magazine therebelow.

In addition to being able to practically freely load two types of ammunition, there additionally results a relatively simple way of replenishing the ring magazine employed, without having to return the ammunition over the supply path.

BRIEF DESCRIPTION OF THE DRAWINGS

The invention will now be described in greater detail with reference to an embodiment that is illustrated in the attached drawings in which.

DESCRIPTION OF THE PREFERRED EMBODIMENT

Figure 1:
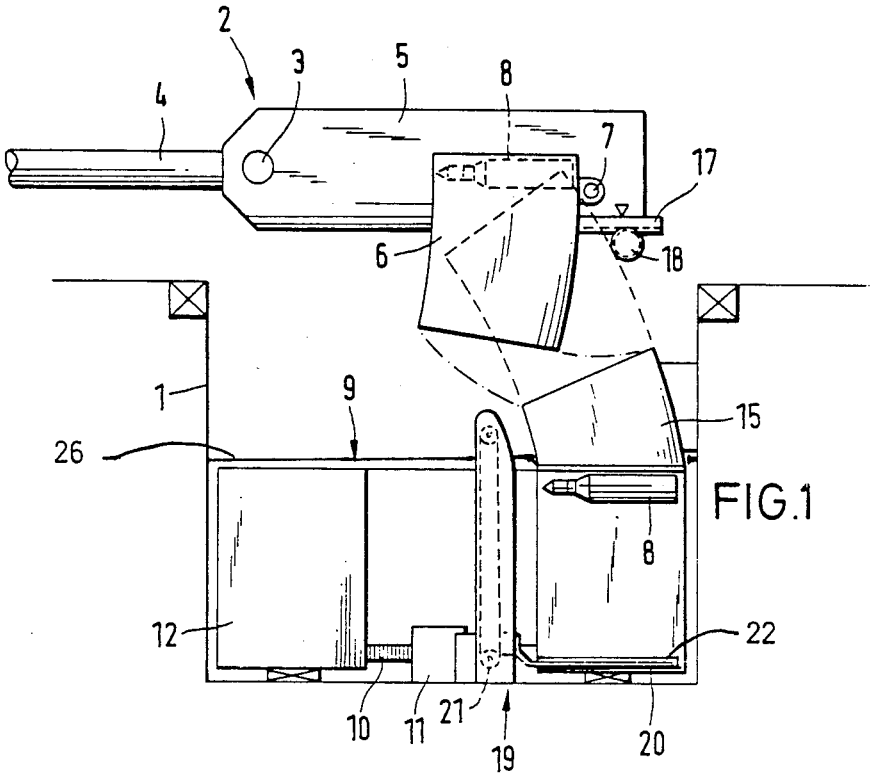
FIG. 1 is a schematic side view of a device for storing and loading ammunition in a turret.
Figure 2:
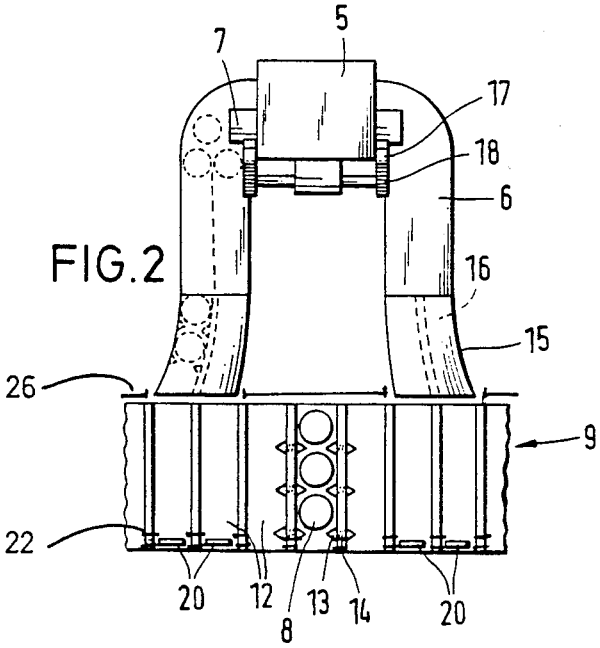
FIG. 2 is a rear sectional view of the device of FIG. 1.

FIG. 1 shows a turret basket 1, for example of a tank, which is rotatably accommodated in a chassis and is equipped with an automatic tubular weapon 2, which is mounted so as to be vertically pivotable about a horizontally extending trunnion 3 and includes a gun barrel 4 as well as a bottom member 5. On each side of bottom member 5, there is a shaft magazine 6 which is articulated at its rear side to hinge 7 so as to be pivotable about an axis perpendicular to the longitudinal axis of tubular weapon 2. The unbelted ammunition 8 received from shaft magazine 6 travels from there into tubular weapon 2 where it is fired. The manner of holding and transporting ammunition 8 in and from shaft magazine 6 into the firing position is known and not illustrated.

A ring magazine 9 is rotatably mounted at the bottom of turret basket 1. Ring magazine 9 has, for example, a ring of internal teeth 10 with which it can be rotated in an indexed manner by means of a drive 11.

Ring magazine 9 has radially juxtaposed perpendicular shafts 12 which receive ammunition 8 superposed on one another with the projectile tips oriented inwardly to that the ammunition as a whole is arranged in several layers in a star pattern. Ammunition 8 is held within shafts 12 by means of spring loaded abutments 13, with abutments 13 supporting the underside of ammunition 8. However, if a corresponding force is exerted against the tension of the respective springs 14, abutments 13 escape toward the outside so that ammunition 8 is movable vertically in shafts 12 for loading and removal, respectively. Shafts 12 are closed at their top ends, for example, with individual tops (not shown in the Figure) which are opened for loading and are articulated to a cover 26 (schematically illustrated in FIG. 1) connected to the turret basket 1 and covering the magazine 9. No tops are provided in the cover 26 at the site of ammunition transmission. The ammunition 8 is pressed into shafts 12 until the latter are full.

Two auxiliary shaft devices 15 are fixed to the turret above ring magazine 9 and adjacent to and below shaft magazine 6. Their auxiliary shafts 16, when seen from the side, have an essentially circular ring segment shape so that, if shaft magazine 6 are pivoted downwardly about hinges 7, their undersides are flush with the upper sides of auxiliary shaft devices 15. An auxiliary shaft device 15 has as many, essentially vertically arranged auxiliary shafts 16 as has each shaft magazine 6, with the auxiliary shafts 16 possibly being helically curved so as to compensate for the position of the ammunition which in ring magazine 9 is in the form of a star and in shaft mgazine 6 in parallel, thus ensuring a proper transition between the latter.

Shaft magazine 6, for example, is equipped with a toothed rod 17, which is in engagement with a driven pinion 18 at bottom member 5 of tubular weapon 2, so that both shaft magazines 6 can be pivoted together from the position shown in solid lines in FIG. 1 into the replenishment position shown in dashed lines. For this purpose, tubular weapon 2 must take on an indexed position, e.g. an elevation of 0°, so that shaft magazines 6 comes into engagement with auxiliary shaft device 15.

Two lifting devices 19 are provided with which ammunition 8 can be moved from shafts 12 and 16 into shaft magazines 6. For this purpose, arms 20 extending into the bottom portion of ring magazine 9 can be lifted into respectively aligned shafts 12 by means of a lever device or a correspondingly guided chain drive 21, from the bottom of shafts 12 to the exit end of shafts 16. The number of arms 20 corresponds to the number of shafts in a shaft magazine 6 or to the number of associated auxiliary shafts 16, respectively. Ring magazine 9 is inwardly open at its bottom so as to be rotatable without interference from arms 20. That is, the lower portions of the partitions of the ring magazine 9 are slotted at 22 as illustrated in FIG. 1 and permit the magazine 9 to rotate when the arms 20 are at a lower index setting.

If the force required to raise the arms 20 exceeds a given value, this indicates that shaft magazine 6 is full and the drive 21 for arms 20 is reversed to return arms 20 into their starting position above the bottom of ring magazine 9.

This can be controlled, for example, by means of sensors. Additionally, the control of the lifting movement of the arms 20 may be controlled by sensors (not shown) attached, for example, to the side of the magazine shafts 12 which, when the arms 20 reach the upper position, set off an automatic return of the arms 20 to the lower index position. The sensor inquiry and retransmission of the command to the drives 21 is performed, in a known manner, by an automatic computer control (not shown).

Shafts 12 of ring magazine 9 can be charged from the top with two different types of ammunition as desired. Auxiliary shafts 16 will normally also be loaded, namely if two types of ammunition are employed, i.e. one type of ammunition on one side of tubular weapon 2 and one type of ammunition on the other side. Then one certain type of ammunition is fired through one shaft magazine 6 and the other type of ammunition is fired through the other shaft magazine 6.

Once shaft magazines 6 have been shot partially or completely empty, they are replenished. For this purpose, tubular weapon 2 pivots into the loading position—preferably with 0° elevation—and shaft magazines 6 pivot into the position shown in dashed lines so that they are in communication with auxiliary shaft devices 15. Ring magazine 9 carrying the selected type of ammunition is brought by rotative movement thereof in an indexed position underneath the respective auxiliary shaft 16 (or a plurality of auxiliary shafts 16). By means of the lifting device 19, shaft magazine 6 can then be filled. Preferably the number of cartridges in auxiliary shaft 16 and shaft 12 of ring magazine 9 corresponds to the quantity to be received by shaft magazine 6, so that one-time replenishment of ammunition suffices for complete reloading. Otherwise, the remaining quantity can be replenished by rotation of ring magazine 9 and partial removal of ammunition 8 from one shaft 12. Thereafter, shaft magazines 6 are pivoted back into the position shown in solid lines so that tubular weapon 2 is ready for firing again.

Due to the fact that auxiliary shaft device 15 and shaft magazine 6 are each provided twice, one or a plurality of separate shafts exist for each type of ammunition.

Replenishment of ring magazine 9 is possible without access to the supply path for ammunition 8 to tubular weapon 2.

The invention now being fully described, it will be apparent to one or ordinary skill in the art that many changes and modifications can be made thereto without departing from the spirit or scope of the invention as set forth herein.

The present disclosure relates to the subject matter disclosed in German Application P No. 37 02 426.4-15 of Jan. 28th, 1987, the entire specification of which is incorporated herein by reference.

What is claimed is:

1. A weapon device, comprising:

a holding member for holding ammunition prior to launch through an end thereof, said holding member having first and second opposite sides;

first and second shaft magazines respectively mounted to said opposite sides of said holding member, each of said first and second shaft magazines having at least one shaft;

a turret having a turret basket;

a ring magazine rotatively mounted in said turret basket for rotation about a vertical axis, said ring magazine having a plurality of vertical radially oriented ring shafts for receiving ammunition;

drive means for rotating said ring magazine about said vertical axis;

an auxiliary shaft device having auxiliary shafts and being fixed to said turret above said ring magazine so that respective ones of said ring shafts are alignable with said auxiliary shafts upon rotation of said ring magazine by said drive means, said auxiliary shaft device being fitted to said turret below said first and second shaft magazines, said holding member being moveable into and away from an indexed position in which the shafts of said first and second shaft magazines are aligned with said auxiliary shafts therebelow; and a lifting device having means for lifting ammunition stored in said ring magazine into said first and second shafts via said auxiliary shafts;

wherein said holding member is a tubular weapon pivotable about a horizontal axis relative to said turret, and wherein said first and second shaft magazines are pivotally mounted to said tubular weapon for pivotal movement about an axis parallel to said horizontal axis between a first position in which said first and second shaft magazines are spaced from said auxiliary shaft device and a second position in which said first and second shaft magazines are aligned with said auxiliary shaft device when said tubular weapon is in said indexed position, said indexed position defining a predetermined pivotal position of said tubular weapon about said horizontal axis.

2. A device as in claim 1, wherein said auxiliary shafts are helically curved.

3. A device as in claim 2, wherein said lifting device includes at least one arm which is movable in one of said ring shafts and one of the auxiliary shafts aligned with the ring shaft, and means for moving said at least one arm vertically to lift ammunition into one of the shafts of the first and second shaft magazines thereabove.

4. A device as in claim 1, wherein said auxiliary shafts of said auxiliary device corresponds in number to the number of shafts in said first and second shaft magazines.

5. A device as in claim 1, wherein each of said auxiliary devices and the ring shafts which are aligned therewith together comprise means for storing a quantity of ammunition corresponding to a maximum quantity of ammunition which can be accommodated in one of said first and second shaft magazines.

* * * * *